US006934503B2

(12) United States Patent
Tsuchiya et al.

(10) Patent No.: US 6,934,503 B2
(45) Date of Patent: Aug. 23, 2005

(54) PRINTER

(75) Inventors: Takashi Tsuchiya, Kawasaki (JP); Katsuhiko Funaki, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/485,852

(22) PCT Filed: Aug. 9, 2001

(86) PCT No.: PCT/JP01/06888

§ 371 (c)(1),
(2), (4) Date: Mar. 17, 2004

(87) PCT Pub. No.: WO03/017007

PCT Pub. Date: Feb. 27, 2003

(65) Prior Publication Data

US 2005/0031391 A1 Feb. 10, 2005

(51) Int. Cl.[7] ..... G03G 15/00; G03G 15/22

(52) U.S. Cl. ..... 399/384; 399/306; 399/309; 399/405; 399/407

(58) Field of Search ..... 399/384, 306, 399/309, 405, 407

(56) References Cited

U.S. PATENT DOCUMENTS 6,118,956 A 9/2000 Hirao
6,175,715 B1 * 1/2001 Hirao et al. ..... 399/384
6,188,853 B1 * 2/2001 Ishida et al. ..... 399/38
6,192,213 B1 * 2/2001 Wada et al. ..... 399/306
6,292,649 B1 * 9/2001 Toyama et al. ..... 399/384
6,317,581 B1 * 11/2001 Boehmer et al. ..... 399/401
6,339,692 B2 * 1/2002 Yoshida et al. ..... 399/384
6,466,761 B1 * 10/2002 Rene et al. ..... 399/308
6,785,488 B2 * 8/2004 Katsuyama ..... 399/84
6,823,158 B2 * 11/2004 Yamada et al. ..... 399/179

FOREIGN PATENT DOCUMENTS

| | | |
|---|---|---|
| JP | A 63-212949 | 9/1988 |
| JP | A 3-235970 | 10/1991 |
| JP | A 8-104450 | 4/1996 |
| JP | A 10-166672 | 6/1998 |
| JP | A 11-352733 | 12/1999 |
| JP | A 2000-10369 | 1/2000 |

* cited by examiner

*Primary Examiner*—Ren Yan
*Assistant Examiner*—Marvin P. Crenshaw
(74) *Attorney, Agent, or Firm*—Oliff & Berridge, PLC

(57) ABSTRACT

A printer prints on two sides of a sheet of paper having continuous pages, and discharges the paper to a postprocessor for disconnecting the paper in page units and storing the disconnected sheets of paper in a stack. Depending on whether the postprocessor has an inversion mechanism that inverts front and back sides of the paper, sides of the paper on which data for the front side of the paper and data for the back side of the paper are printed are switched. With this arrangement, even when the postprocessor does not have the inversion mechanism, the front side data is printed on the back side, and the back side data is printed on the front side thereby enabling the postprocessor to stack the disconnected sheets of paper in page units in the order of page numbers.

7 Claims, 8 Drawing Sheets

PRINTER

BACKGROUND OF THE INVENTION

1. Field of the Invention

The present invention relates to a printer that discharges a sheet of paper having continuous pages to a postprocessor that disconnects this paper into sheets of paper in page units, and stores the disconnected sheets of paper in a stack. Particularly, the invention relates to a printer that switches print sides of the sheets based on presence or absence of an inversion mechanism that inverts the front and back sides of the sheets in the postprocessor.

2. Description of the Related Art

There are printers that can print on both sides of a sheet of paper having continues pages. The sheet of paper printed by the printer is stored into a body stacker that is incorporated in the printer main body or into a stacker of a postprocessor (for example, a Burster Trimmer Stacker) (hereinafter referred to as a "BTS stacker") that receives the sheet of paper discharged from the printer, disconnects the printed paper into sheets of paper in page units by cutting or by bursting, and stores the disconnected sheets of paper in a stack.

FIG. 7 is a view showing the storage of paper. A printer 1 has a lever 2 that selects a stacker which stores a printed sheet of paper. FIG. 7A illustrates that the lever 2 selects a body stacker 3 that is incorporated in the printer 1. The printed sheet of paper is folded in page units, and is stored into the body stacker 3. On the other hand, FIG. 7B illustrates that the lever 2 selects a BTS stacker 6 of a postprocessor 5. The sheet or paper printed by the printer 1 enters the postprocessor 5 from a vent 4 of the printer. A disconnection mechanism not shown disconnects the sheet of paper into sheets of paper in page units, and stores the disconnected paper in a stack in the BTS stacker 6.

When sheets of paper printed on both sides of the paper are stored into the BTS stacker 6 of the postprocessor 5, the following problems arise.

FIG. 8 is a view showing a page layout of a two-side printed sheet of paper that is discharged from the printer. A first front side of the printed sheet of paper is the first page, and a back side of this paper is the second page. A front side that continues after the first page is the third page. A back side that continues after the second page is the fourth page. In other words, odd pages appear on the front side, and even pages appear on the back side of the paper. Therefore, in this page layout, the printed sheet of paper enters the postprocessor 5, and is disconnected into sheets of paper in page units. As shown in FIG. 8A, the disconnected sheets of paper are stacked on the BTS stacker 6, with page numbers appearing in the order of 2, 1, 4, 3, 6, 5, and so on from the bottom. Consequently, the page numbers are not continuous.

On the other hand, some postprocessor 5 has an inversion mechanism that inverts the front and back sides of the sheets of paper that are discharged from the printer. When the inversion mechanism is used, the page layout is reverse of the above, with the front side being an even page and the back side being an odd page, as shown in FIG. 8B. Therefore, when the sheet of paper is disconnected into sheets of paper in page units, and the disconnected sheets of paper are stacked on the BTS stacker 6, the page numbers appear as 1, 2, 3, 4, 5, and so on in this order from the bottom. Consequently, the page numbers are continuous in good order.

As explained above, when the postprocessor 5 has the inversion mechanism, the printed sheets of paper are stored in the BTS stacker 6 in a state in which the page numbers are continuous. However, when the postprocessor 5 does not have the inversion mechanism (that is, when the printed sheet of paper enters the postprocessor 5 in a state of being discharged from the printer 1, and when the paper disconnected into sheets of paper in page units are stored), the printed sheets of paper are stacked on the BTS stacker 6 in a state in which the page numbers are not continuous.

SUMMARY OF THE INVENTION

It is an object of the present invention to provide a printer that discharges a printed sheet of paper to a postprocessor for disconnecting the paper into sheets of paper in page units and storing the disconnected sheets of paper in a stack, wherein the postprocessor can stack the printed sheets of paper on a stacker of the postprocessor such that page numbers are in a continuous order regardless of presence or absence of an inversion mechanism that inverts the front and back sides of the sheets.

In order to achieve the above object, according to one aspect of the invention, there is provided a printer which is capable of printing on a front side and a back side of a sheet of paper having continuous pages, and discharging the paper to a postprocessor for disconnecting the paper in page units and storing the disconnected sheets of paper in a stack, the printer comprising: a first printing unit that prints a first side of the paper; a second printing unit that prints a second side of the paper; a deciding unit that determines whether the postprocessor has an inversion mechanism that inverts front and back sides of the paper that is discharged from the printer; and a control unit that determines which one of the first and second printing units prints a first print data portion for the first side of the paper and a second print data portion for the second side of the paper in the print data respectively, based on presence or absence of the inversion mechanism.

Specifically, when two-side printing is instructed, and when the postprocessor does not have the inversion mechanism, the control unit supplies the first print data portion of the print data for the first side of the paper to the second printing unit such that this print data portion is to be printed on the second side of the paper, and supplies the second print data portion for the second side of the paper to the first printing unit such that this print data portion is to be printed on the first side of the paper. When the postprocessor has the inversion mechanism, the control unit supplies the first print data portion to the first printing unit such that this print data portion is to be printed on the first side of the paper, and supplies the second print data portion to the second printing unit such that this print data portion is to be printed on the second side of the paper.

As explained above, when the postprocessor that is connected to the printer does not have the inversion mechanism, the print data for the first side (i.e., the first print data portion) is printed on the second side of the paper, and the print data for the second side (i.e., the second print data portion) is printed on the first side of the paper. With this arrangement, the paper that is disconnected into page units by the postprocessor can be stacked in the order of page numbers.

Further, when one-side printing is instructed, and when the postprocessor does not have the inversion mechanism, the control unit supplies the first print data portion to the second printing unit such that this print data portion is to be printed on the second side of the paper, and supplies white paper data to the first printing unit such that this data is to be printed on the first side of the paper thereby enabling the first printing unit and the second printing unit to execute two-side printing.

Accordingly, in one-side printing, even when the postprocessor does not have the inversion mechanism, when the print side of each sheet of paper stacked on the stacker of the postprocessor is faced upward, the sheets of paper can be stacked in correct order of pages starting from the first page.

Further, the deciding unit determines the presence or absence of the inversion mechanism based on flag information that is set by a predetermined setting unit and that indicates whether the postprocessor has the inversion mechanism.

In order to achieve the above object, according to another aspect of the invention, there is provided a printer which is capable of printing on a first side and a second side of a sheet of paper having continuous pages, the printer comprising: a first printing unit that prints on the first side of the paper; a second printing unit that prints on the second side of the paper; a postprocessing unit that disconnects a printed sheet of paper in page units, and stores the disconnected sheets of paper in a stack; a deciding unit that determines whether the postprocessing unit has an inversion mechanism that inverts front and back sides of the printed sheets of paper; and a control unit that determines which one of the first and second printing units prints a first print data portion for the first side of the paper and a second print data portion for the second side of the paper in the print data respectively, based on presence or absence of the inversion mechanism.

DETAILED DESCRIPTION OF THE PREFERRED EMBODIMENTS

The embodiment of the present invention will be explained below with reference to the drawings. However, the technical range of the invention is not limited by the embodiment.

Figure 1:
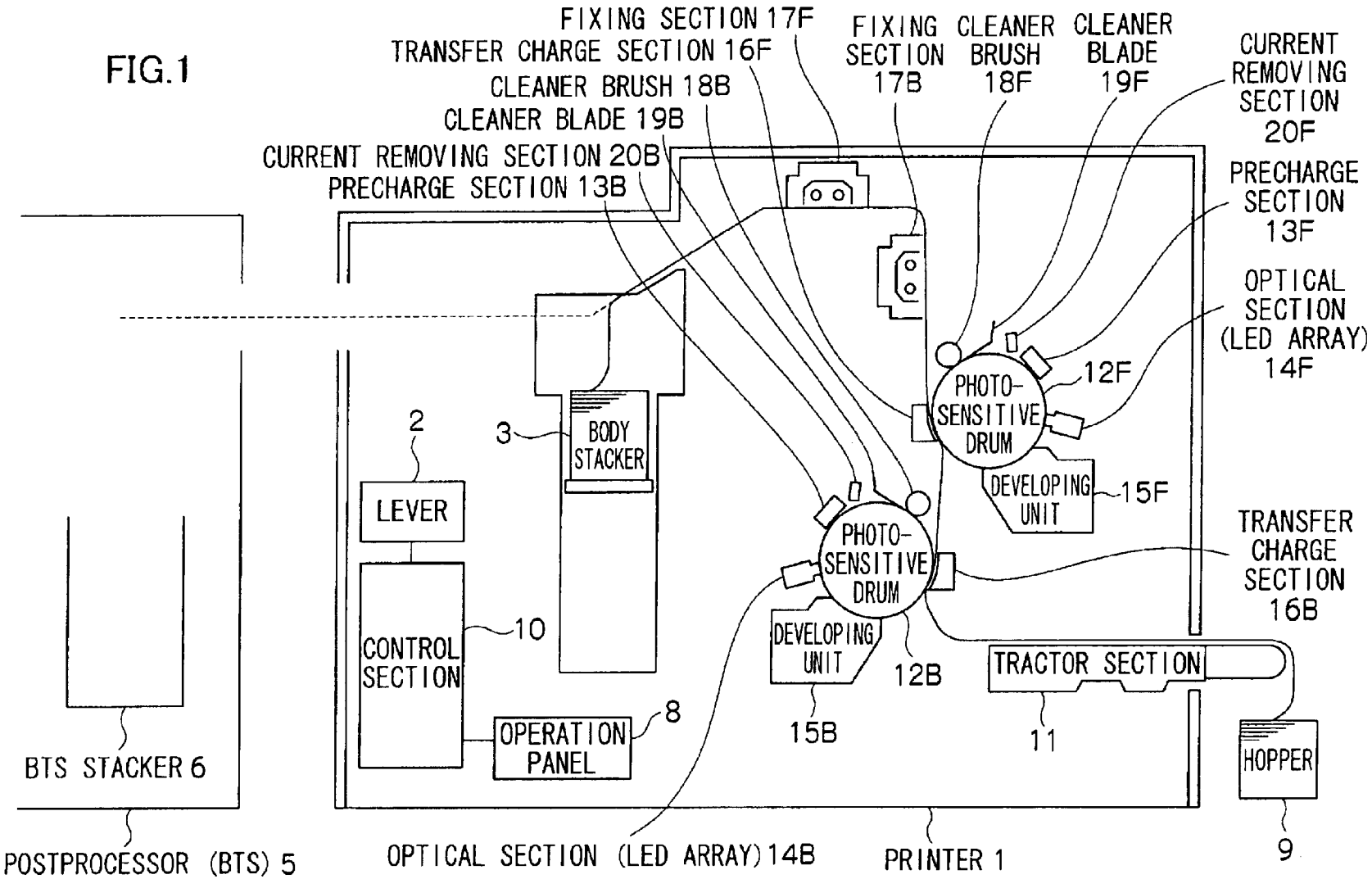
FIG. 1 is a block configuration diagram of a printer according to an embodiment of the present invention.

FIG. 1 is a block configuration diagram of a printer according to the embodiment of the invention. A control section 10 receives a print command and print data from a host unit, and executes a print processing following a control from the control section 10. Specifically, in the printer, a sheet of paper within a hopper 9 is taken into the printer via a tractor section 11. The printer has photosensitive drums 12F and 12B for a front side (F) and a back side (B) respectively to be able to execute two-side printing. Precharge sections 13F and 13B charge the photosensitive drums 12F and 12B. Optical sections 14F and 14B irradiate beams onto the photosensitive drums 12F and 12B to form latent images corresponding to print information on these photosensitive drums. Toners within developing units 15F and 15B adhere to the latent image portions that are formed on the photosensitive drums 12F and 12B. Transfer charge sections 16F and 16B transfer the toners from the photosensitive drums 12F and 12B onto the sheet of paper. Fixing sections 17F and 17B fix the toners that are transferred onto the paper. Cleaner brushes 18F and 18B and cleaner blades 19F and 19B work to retrieve residual toners from the surfaces of the photosensitive drums into the developing units 15F and 15B respectively. Current removing sections 20F and 20B once release the charging from the photosensitive drums 12F and 12B.

The lever 2 can fold and store the paper that passes through the fixing sections 17F and 17B, into the body stacker 3 within the printer, or discharge this paper to the outside, by switching. The paper that is discharged to the outside is guided to the postprocessor (for example, the Burster Trimmer Stacker (BTS)) 5. The postprocessor 5 receives the paper discharged from the printer 1, disconnects the paper in page units, and stores the disconnected sheets of paper in a stack in the stacker within the postprocessor. The postprocessor may have an inversion mechanism that inverts the front and back sides of the paper discharged from the printer as described above.

The printer 1 has an operation panel 8 on which various kinds of print conditions can be set. A state set by the operation panel and a state of the lever 2 are stored in a predetermined memory of the control section 10.

Figure 2:
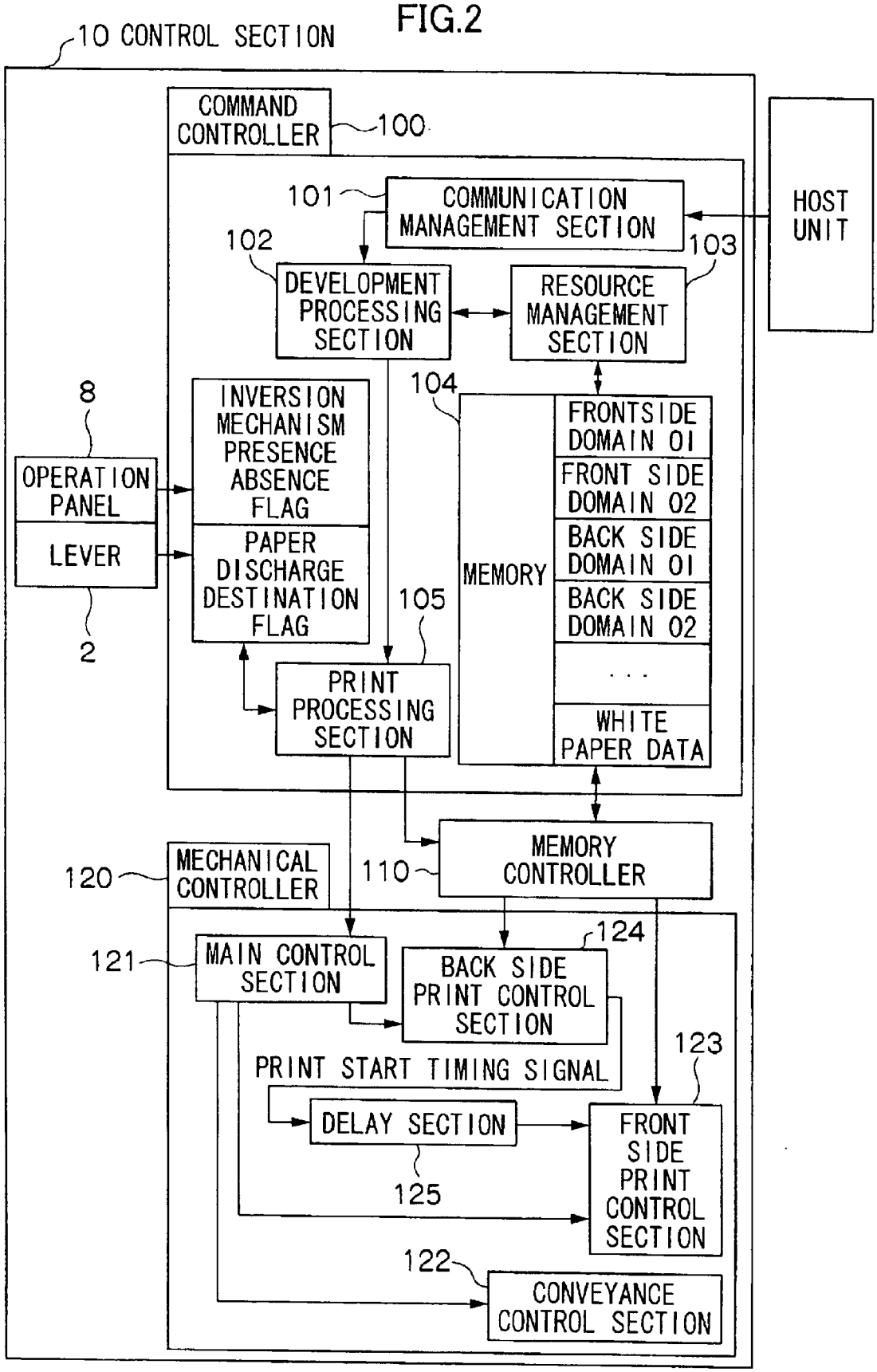
FIG. 2 is a block configuration diagram of a control section of the printer according to the embodiment of the invention.

FIG. 2 is a block configuration diagram of the control section of the printer according to the embodiment of the invention. The control section 10 includes a command controller 100, a memory controller 110, and a mechanical controller 120. A communication management section 101 of the command controller 100 receives a print command and print data from a host unit via a predetermined interface, and transfers the received print command and print data to a development processing section 102. The print command has various kinds of information concerning print such as data amount (i.e., data size), and two-side/one-side print information. Print data that extends across a plurality of pages is separated by page units, and is transmitted (hereinafter, the print data in page units may be referred to as "page data"). The development processing section 102 stores the received print data in page units into an unused domain of the memory 104 that is managed by a resource management section 103. The memory 104 has a plurality of front side domains that store page data printed on the front side of the paper, a plurality of back side domains that store page data printed on the back side of the paper, and a domain that stores white paper data, as described later.

The development processing section 102 transfers a destination for storing the print command and each page data within the memory 104 (i.e., a header address and a size) to the print processing section 105. The print processing section 105 issues a predetermined print request to the mechanical controller 120, and instructs the memory controller 110 to read the print data from the memory 104 and transfer the read print data to the mechanical controller 120. Specifically, the print processing section 105 notifies the memory controller 110 about read original information including the header address and the size of the memory domain in which each page data is stored, and transfer destination information (a front side print control section 123 or a back side print control section 124) corresponding to each page data, such that the page data is printed in page order. Further, as described later, the print processing section 105 according to the invention determines a transfer destination of the read print data based on presence or absence of the inversion mechanism of the postprocessor that is connected to the printer.

The memory controller 110 reads the page data from the memory domain that is assigned by the header address and the size, and transfers the read page data to the corresponding print control section (the front side print control section 123 or the back side print control section 124) in the mechanical controller 120. The memory controller 110 is a Direct Memory Access (DMA) controller, for example, and DMA transfers the data in the memory 104 to the mechanical controller 120. The DMA transfer is data transferred directly from the device to the memory or from the memory to the device without passing through a CPU (not shown) of the control section 10 thereby enabling high-speed data transfer.

The main control section 121 of the mechanical controller 120 notifies a conveyance control section 122 about a total size of the print data included in the print request from the print processing section 105. The conveyance control section 122 controls a paper conveyance mechanism such as the tractor section to drive over a predetermined distance. The main control section 121 drives only the front side print control section 123 or drives both the front side print control section 123 and the back side print control section 124, according to the one-side/both-side print information that is included in the print request. The front side print control section 123 or the back side print control section 124 controls the drive of the print mechanism such as the photosensitive drums 12F and 12B, the developing units 15F and 15B, and the fixing section 17F and 17B for the front side or the back side respectively shown in FIG. 1. As shown in FIG. 1, a front side print position and a back side print position are out of alignment on a paper conveyance route. Specifically, the front side photosensitive drum 12F is positioned in front of the back side photosensitive drum 12B in the paper proceeding direction. Therefore, when two-side printing is carried out, it is necessary to slide the timing of printing on the front side and the back side of the paper. Accordingly, when the two-side printing is carried out, a delay section 125 is provided to delay the drive timing of the front side print control section 123 by a predetermined time from the drive timing of the back side print control section 124.

When two-side printing is carried out, the main control section 121 starts the delay section 125. The delay section 125 delays a print start timing signal that is input from the back side print control section 124 by a predetermined time, and outputs this signal to the front side print control section 123. The front side print control section 123 controls the printing in synchronism with the print start timing signal that is delayed by the delay section 125. With this arrangement, the front side print position coincides with the back side print position of the paper, at the time of two-side printing.

Figure 3:
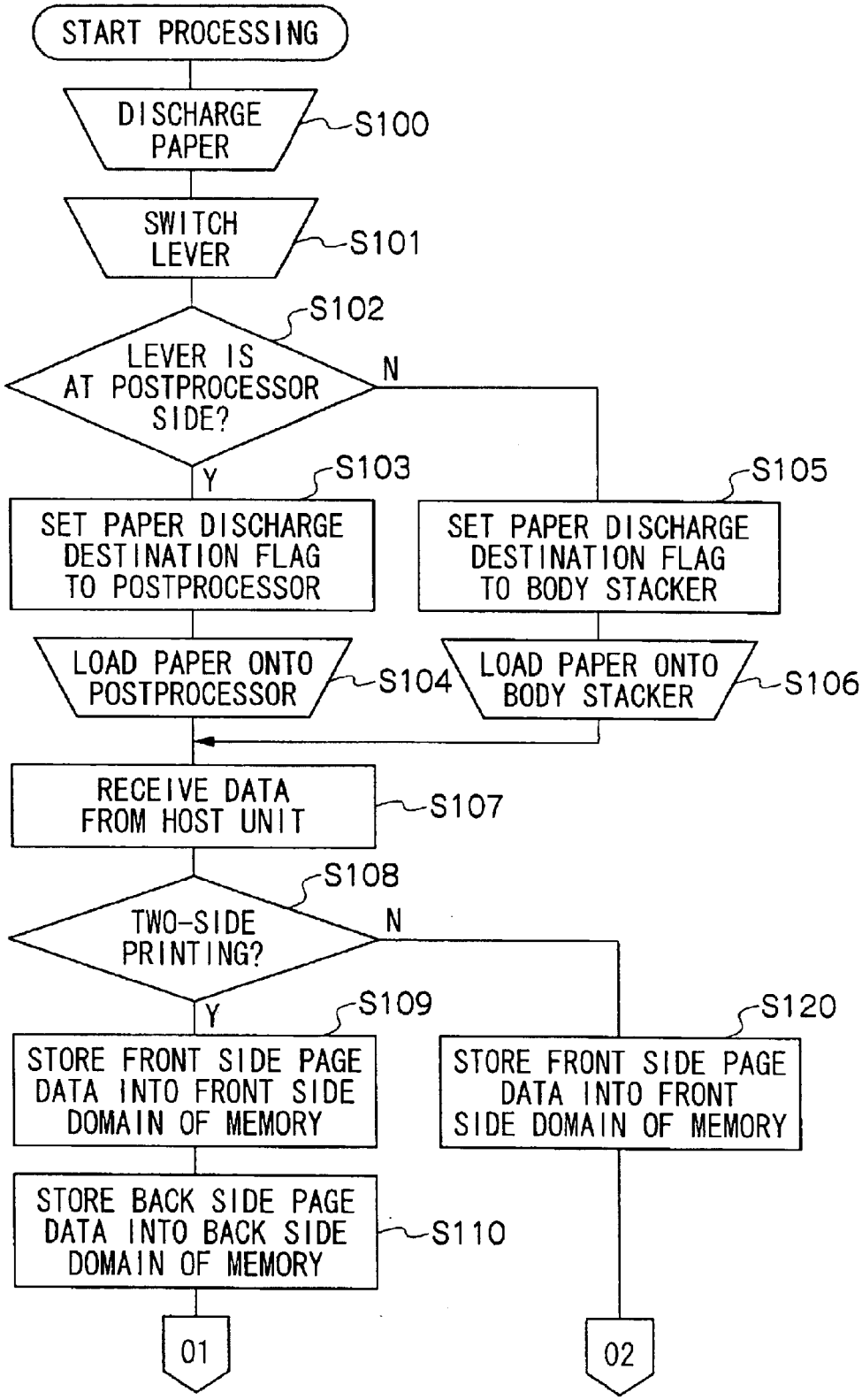
FIG. 3 and FIG. 4 are flowcharts of a print processing according to the embodiment of the invention.
Figure 4:
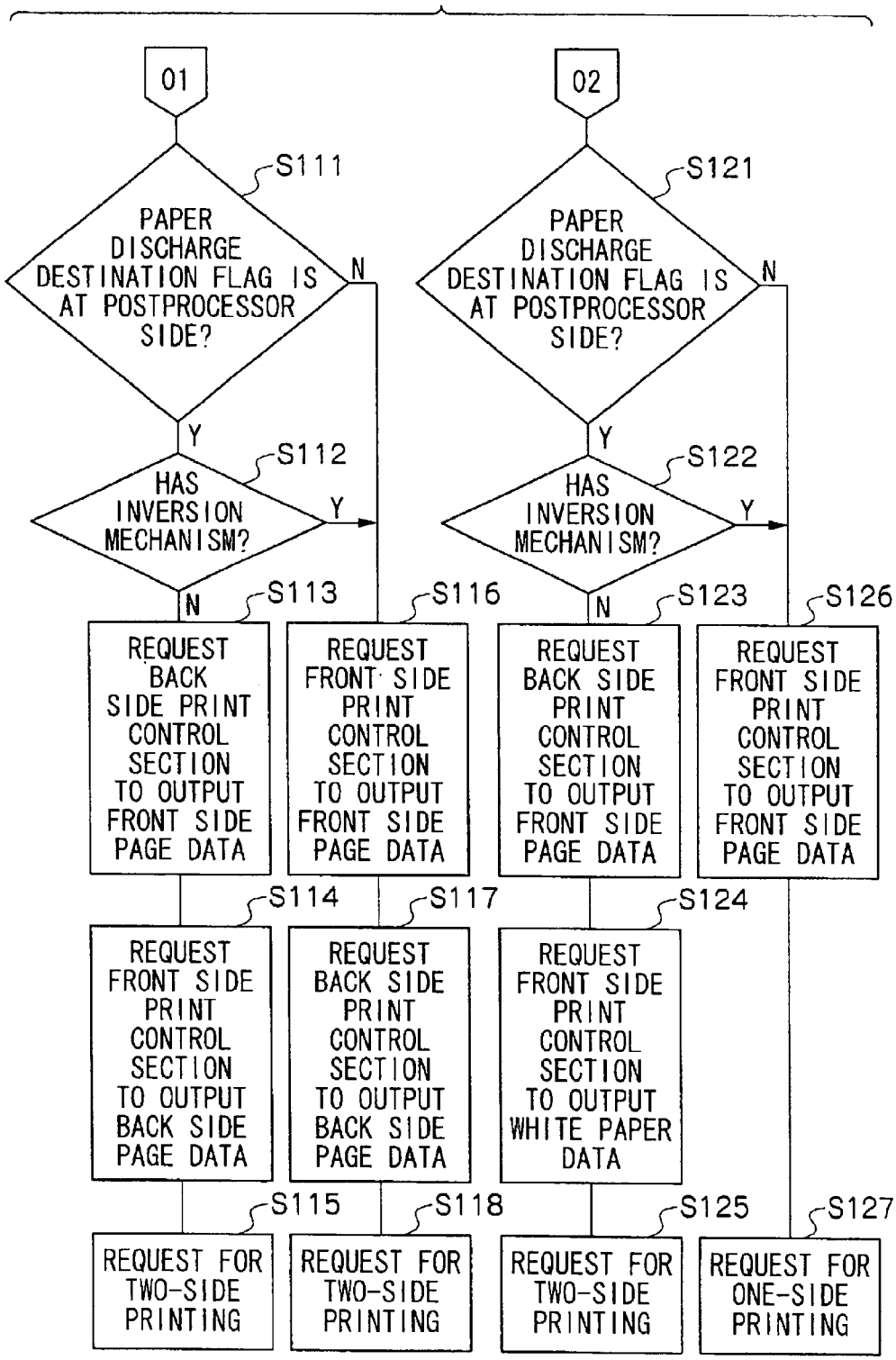

FIGS. 3 and 4 are flowcharts of a print processing according to the embodiment of the invention. In FIG. 3, when the lever 2 switches a paper discharge destination, as a first print preprocessing, a predetermined paper discharge button (not shown) is depressed to discharge paper that remains on the conveyance route in the preceding printing (S100). The lever is switched from the body stacker 3 to the BTS stacker 6 of the postprocessor 5, or from the BTS stacker 6 of the postprocessor 5 to the body stacker 3 (S101). At step S102, when the lever 2 is switched from the body stacker 3 to the BTS stacker 6 of the postprocessor 5, the print processing section 105 sets a paper discharge destination flag managed by the print processing section 105 to the postprocessor (S103). The tractor section 11 guides the paper from the hopper 9 to the conveyance route, and loads the paper onto the postprocessor 5 via the vent 4 (S104). When the lever 2 is switched from the BTS stacker 6 to the body stacker 3 at step S102, the print processing section 105 sets the paper discharge destination flag to the body stacker 3 (S105). The tractor section 11 guides the paper from the hopper to the conveyance route, and loads the paper onto the body stacker 3 (S106).

The communication management section 101 of the command controller 100 receives the print command and the print data from the host unit via a predetermined interface (S107). The communication management section 101 transfers the received print command and print data to the development processing section 102. The development processing section 102 determines the one-side/two-side print information in the print command (S108). When the print command is two-side printing, the development processing section 102 stores the front side page data into the front side domain of the memory 104 (S109), and stores the back side page data into the back side domain of the memory 104 (S110). For example, the page data corresponding to the first page is stored into the front side domain of the memory 104, and the page data corresponding to the second page is stored into the back side domain. The page data is sequentially and alternately stored into the front side domain and the back side domain of the memory 104 as explained above.

In FIG. 4, the print processing section 105 determines a paper discharge destination based on the paper discharge flag (S111). The print processing section 105 further determines whether the paper discharge destination is the postprocessor, and determines whether the postprocessor 5 has the inversion mechanism based on an inversion mechanism presence/absence flag (S112). The inversion mechanism presence/absence flag is determined when the device is started. When the print processing section 105 decides that the postprocessor 5 does not have the inversion mechanism based on the inversion mechanism presence/absence flag, the print processing section 105 requests the memory controller 110 to output the page data in the front side domain within the memory 104 to the back side print control section 124 (S113). The print processing section 105 requests the memory controller 110 to output the page data in the back side domain to the front side print control section 123 (S114). As explained above, according to the embodiment, when the postprocessor does not have the inversion mechanism, the page data for the front side is printed on the back side of the paper, and the page data for the back side is printed on the front side of the paper. Accordingly, the paper is situated in the same state as that when the inversion mechanism of the postprocessor 5 inverts the paper. The postprocessor 5 disconnects the paper in this inverted state, and stacks the disconnected sheets of paper on the BTS stacker 6. Consequently, even when the postprocessor does not have the inversion mechanism, the sheets of paper can be stored continuously in page order.

The print processing section 105 issues a two-side print request to the main control section 121 of the mechanical controller 120 to drive both the front side print control section 123 and the back side print control section 124 (S115).

Figure 5:
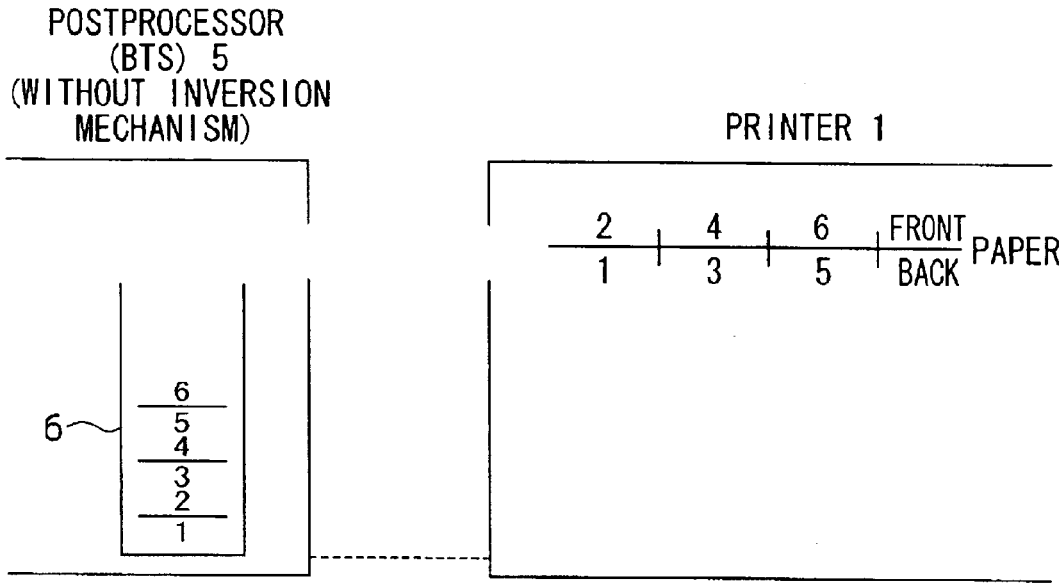
FIG. 5 is a view showing a page layout on a sheet of two-side printed paper that is discharged from the printer to a postprocessor 5 having no inversion mechanism according to the embodiment.

FIG. 5 illustrates a page layout on a sheet of two-side printed paper that is discharged from the printer to the postprocessor 5 having no inversion mechanism according to the embodiment. Based on the above processing, the front side print control section 123 prints the page data for the back side domain, and the back side print control section 124 prints the page data for the front side domain. Therefore, the front side of the first page of the printed sheet of paper is the second page, and the back side is the first page. The front side of the next page is the fourth page, and the back side is the third page. In other words, the front side is an even page, and the back side is an odd page. The sheet of paper printed in this page layout enters the postprocessor 5, and is disconnected into sheets of paper in page units. Consequently, the printed sheets of paper can be stacked on the BTS stacker 6 of the postprocessor 5 continuously in the order of pages 1, 2, 3, 4, 5, and so on from the bottom.

When the paper discharge destination is the body stacker 3 at step S111 in FIG. 4, or when the paper discharge destination is the postprocessor 5 at step S111 but the postprocessor 5 has the inversion mechanism at step S112, normal print processing is carried out. In other words, the print processing section 105 requests the memory controller 110 to output the page data in the front side domain within the memory 104 to the front side print control section 123 (S116), and output the page data in the back side domain to the back side print control section 124 (S117). Further, the print processing section 105 issues a two-side print instruction to the main control section 121 of the mechanical controller 120 to drive both the front side print control section 123 and the back side print control section 124 (S118).

Figure 8A:
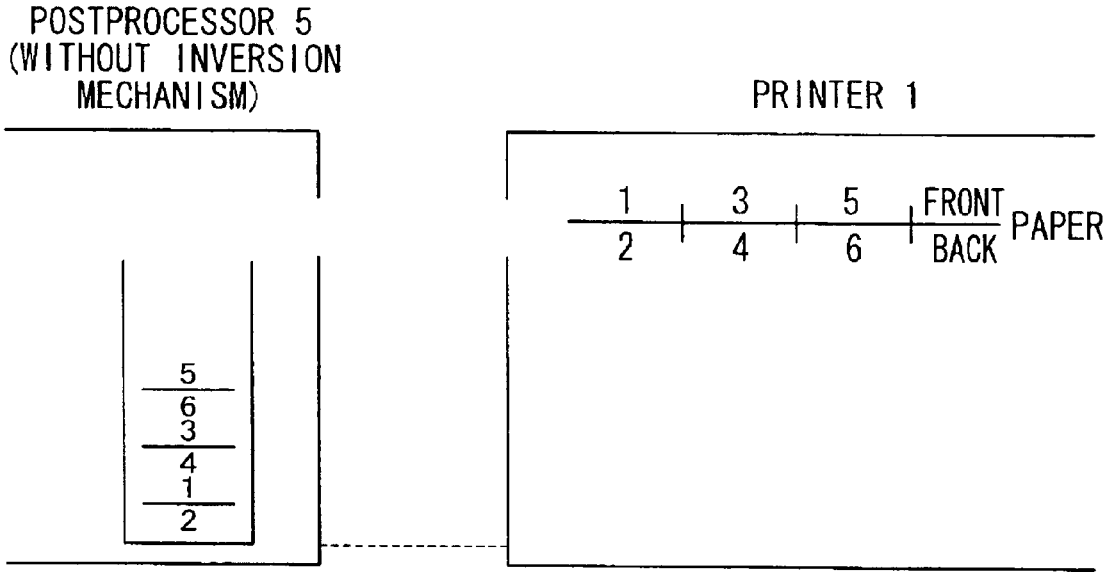
FIG. 8 is a view showing a page layout on a sheet of two-side printed paper that is discharged from the printer according to the conventional system.
Figure 8B:
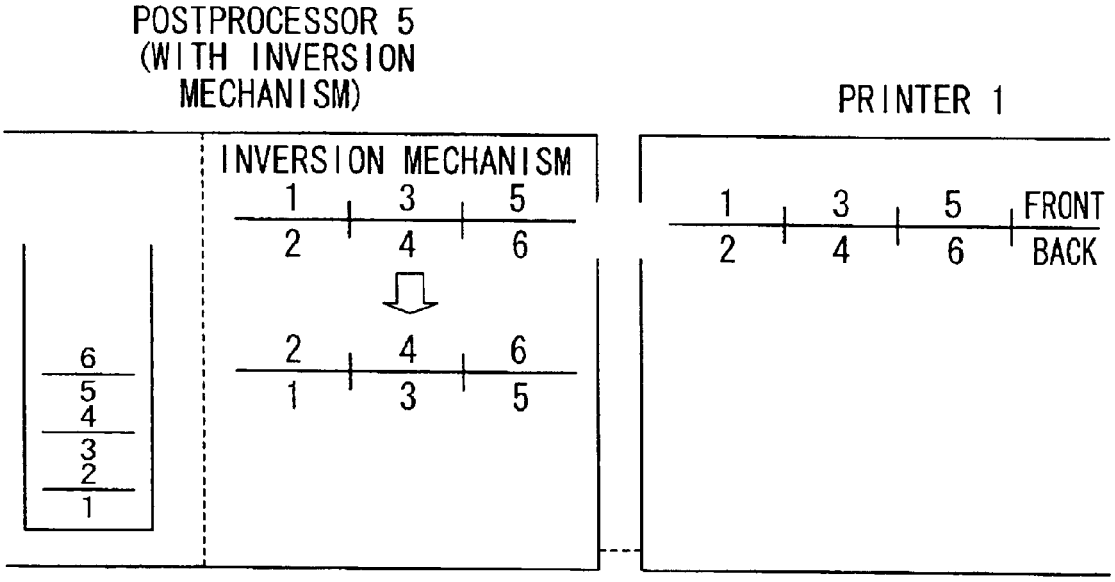

In this case, as shown in FIG. 8B, the odd pages including the first page are printed on the front side, and the even pages including the second page are printed on the back side. However, as the inversion mechanism of the postprocessor 5 inverts the paper, the printed sheets of paper are stacked on the BTS stacker 6 of the postprocessor 5 in a state in which the page number are continuous.

Further, when the development processing section 102 determines that the print command is one-side printing based on the one-side/two-side print information in the print command at step S108 in FIG. 3, the development processing section 102 regards the print data as the front side page data, and stores all the data into the front side domain of the memory 104 (S120).

The print processing section 105 determines a paper discharge destination based on the paper discharge destination flag (S121) whether the paper discharge destination is the postprocessor 5, and also whether the postprocessor has the inversion mechanism based on the inversion mechanism presence/absence flag (S122). When the postprocessor does not have the inversion mechanism, the print processing section 105 requests the memory controller 110 to output the page data in the front side domain within the memory 104 to the back side print control section 124 (S123), and output the white paper data in a predetermined domain within the memory 104 to the front side print control section 123 (S124).

Figure 6A:
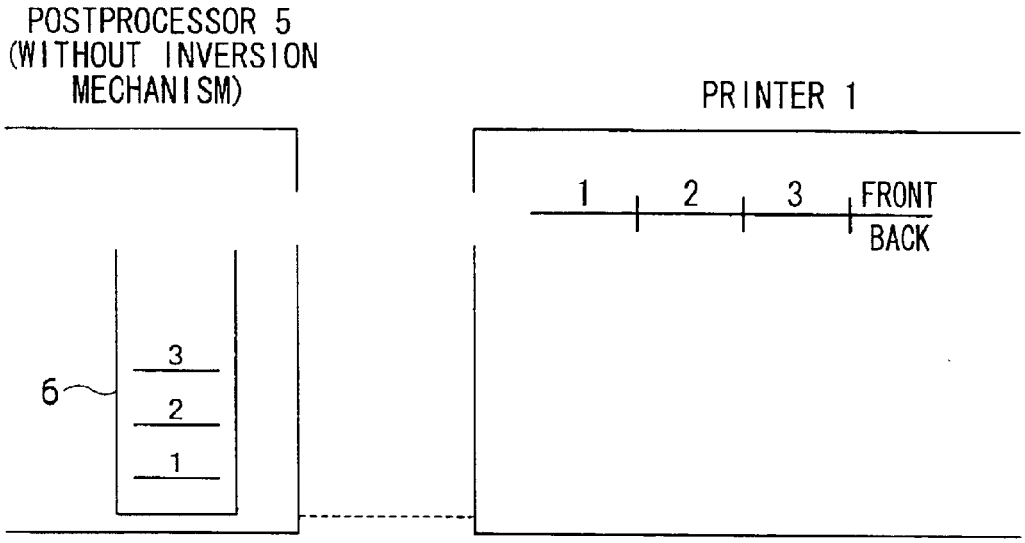
FIG. 6A is a view showing a page layout on a sheet of one-side printed paper according to a conventional system.
Figure 6B:
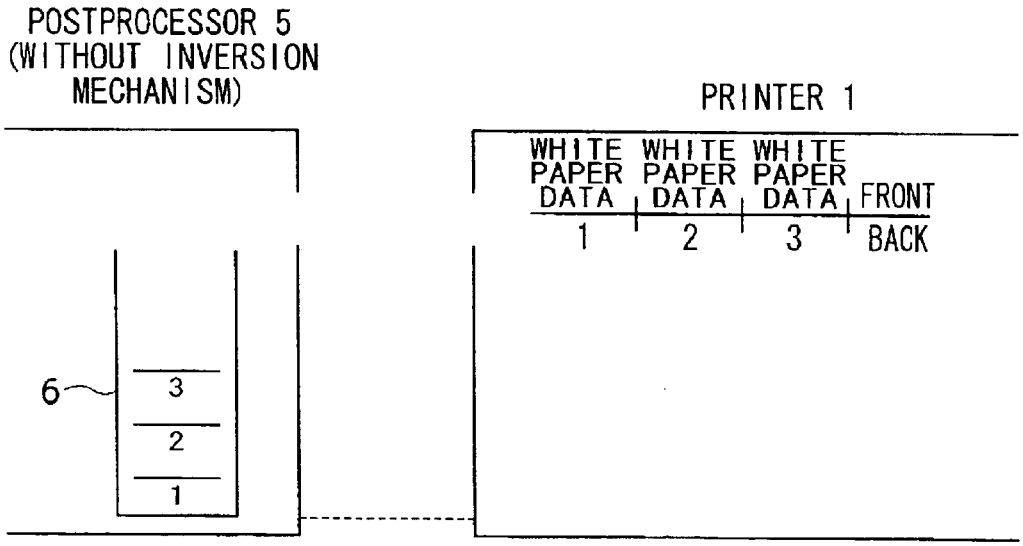
FIG. 6B is a view showing a page layout on a sheet of one-side printed paper according to the embodiment.
Figure 7A:
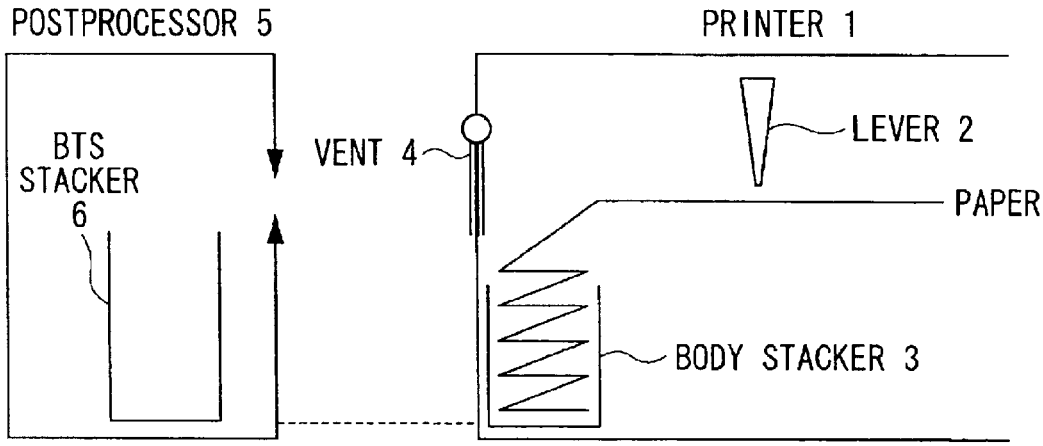
FIG. 7 is a view showing a discharging of a sheet of paper.
Figure 7B:
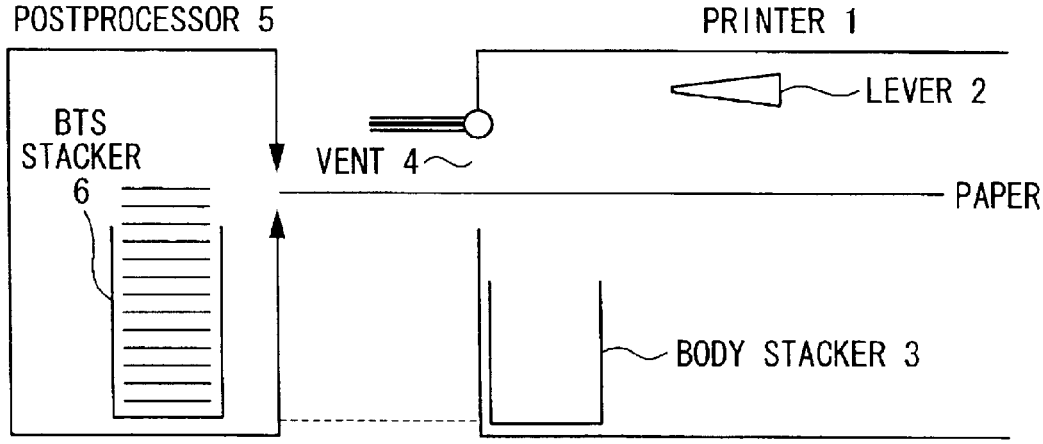

FIGS. 6A and 6B explain about a page layout on a sheet of one-side printed paper. As shown in FIG. 6A, in the one-side printing, when the postprocessor 5 does not have the inversion mechanism, the sheets of paper obtained by disconnecting the paper in page units by the postprocessor 5 are stacked on the BTS stacker 6, with the printed sides (front side) facing upward. When the sheets of paper are taken out from the BTS stacker 6 and when the printed sides of the paper are faced upward, the last page comes to the top of the stacked paper. Although the page numbers are continuous, the page numbers are in opposite order.

As shown in FIG. 6B, in one-side printing, when the postprocessor 5 does not have the inversion mechanism, the print data is printed on the back side of the paper. With this arrangement, the sheets of paper obtained by disconnecting the paper in page units by the postprocessor 5 are stacked on the BTS stacker 6, with the printed sides (back side) facing downward. Therefore, when the sheets of paper are taken out from the BTS stacker 6 and when the printed sides of the paper are faced upward, the first page comes to the top of the stacked paper (by inverting the flux of paper). Consequently, the sheets of paper can be stacked in the correct page order.

Referring back to FIG. 4, the print processing section 105 issues a two-side print request to the main control section 121 of the mechanical controller 120 to drive both the front side print control section 123 and the back side print control section 124 (S125).

As explained above, while the print command from the host unit is one-side printing, the print processing section 105 needs to issue a two-side print request in order to drive the back side print control section 124. In this case, in order to have no printing on the front side, white paper data that is prepared in advance in the memory 104 is output to the front side print control section 123 thereby keeping the front side of the paper white (blank).

In the case of one-side printing, when the paper discharge destination is the body stacker at step S121 or when the paper discharge destination is the postprocessor but the postprocessor has the inversion mechanism at step S122, a normal print processing is carried out. In other words, the print processing section 105 requests the memory controller 110 to output the page data in the front side domain within the memory 104 to the front side print control section 123 (S126). Further, the print processing section 105 issues a one-side print request to the main control section 121 of the mechanical controller 120 to drive only the front side print control section 123 (S127).

In the above embodiment, in order to print the front side page data on the back side and to print the back side page data on the front side, the page data stored in the front side domain of the memory is output to the back side print control section, and the page data stored in the back side domain is output to the front side print control section. However, the means for inverting the print surface of the page data is not limited to this. For example, the page data for the front side may be stored into the back side domain of the memory, and the page data in the back side domain may be output to the back side print control section as usual. The page data for the back side may be stored into the front side domain of the memory, and the page data in the front side domain may be output to the front side print control section as usual.

As explained above, according to the invention, the front side page data is printed on the back side, and the back side page data is printed on the front side. With this arrangement, even when the postprocessor that is connected to the printer does not have the inversion mechanism, the sheets of paper obtained by disconnecting the paper in page units by the postprocessor can be stacked in the order of page numbers.

The protection range of the invention is not limited to the above embodiment, and extends to the invention described in the claims and their equivalents.

What is claimed is:

1. A printer which is capable of printing on a front side and a back side of a sheet of paper having continuous pages, and discharging the paper to a postprocessor for disconnecting the paper in page units and storing the disconnected sheets of paper in a stack, the printer comprising:

a first printing unit that prints a first side of the paper;

a second printing unit that prints a second side of the paper;

a deciding unit that determines whether the postprocessor has an inversion mechanism that inverts front and back sides of the paper discharged from the printer; and a control unit that determines which one of the first and second printing units prints a first print data portion for the first side of the paper and a second print data portion for the second side of the paper in the print data respectively, based on presence or absence of the inversion mechanism.

2. A printer according to claim 1, wherein when two-side printing is instructed, and when the postprocessor does not have the inversion mechanism, the control unit supplies the first print data portion of the print data for the first side of the paper to the second printing unit such that this print data portion is to be printed on the second side of the paper, and supplies the second print data portion for the second side of the paper to the first printing unit such that this print data portion is to be printed on the first side of the paper, and when the postprocessor has the inversion mechanism, the control unit supplies the first print data portion to the first printing unit such that this print data portion is to be printed on the first side of the paper, and supplies the second print data portion to the second printing unit such that this print data portion is to be printed on the second side of the paper.

3. A printer according to claim 2, wherein when the postprocessor does not have the inversion mechanism, and when one-side printing is instructed, the control unit supplies the first print data portion to the second printing unit such that this print data portion is to be printed on the second side of the paper, and supplies white paper data to the first printing unit such that this data is to be printed on the first side of the paper, thereby enabling the first printing unit and the second printing unit to execute two-side printing.

4. A printer according to claim 1, wherein when the postprocessor does not have the inversion mechanism, and when one-side printing is instructed, the control unit supplies the first print data portion to the second printing unit such that this print data portion is to be printed on the second side of the paper, and supplies white paper data to the first printing unit such that this data is to be printed on the first side of the paper, thereby enabling the first printing unit and the second printing unit to execute two-side printing.

5. A printer according to claim 4, wherein the deciding unit determines presence or absence of the inversion mechanism based on flag information that is set by a predetermined setting unit and that indicates whether the postprocessor has the inversion mechanism.

6. A printer according to claim 1, wherein the deciding unit determines presence or absence of the inversion mechanism based on flag information that is set by a predetermined setting unit and that indicates whether the postprocessor has the inversion mechanism.

7. A printer which is capable of printing on a first side and a second side of a sheet of paper having continuous pages, the printer comprising:

a first printing unit that prints on the first side of the paper;

a second printing unit that prints on the second side of the paper;

a postprocessing unit that disconnects a printed sheet of paper in page units, and stores the disconnected sheets of paper in a stack;

a deciding unit that determines whether the postprocessing unit has an inversion mechanism that inverts front and back sides of the printed sheets of paper; and a control unit that determines which one of the first and second printing units prints a first print data portion for the first side of the paper and a second print data portion for the second side of the paper in the print data respectively, based on presence or absence of the inversion mechanism.

* * * * *